US007698984B2

(12) United States Patent
LaBrash et al.

(10) Patent No.: US 7,698,984 B2
(45) Date of Patent: Apr. 20, 2010

(54) BALLISTIC PROJECTILE RESISTANT BARRIER APPARATUS

(75) Inventors: Richard L. LaBrash, Salem, MO (US); Jeffrey D. Percival, Camdenton, MO (US)

(73) Assignee: Defbar Systems LLC, Salem, MO (US)

( * ) Notice: Subject to any disclaimer, the term of this patent is extended or adjusted under 35 U.S.C. 154(b) by 1216 days.

(21) Appl. No.: 11/075,252

(22) Filed: Mar. 8, 2005

(65) Prior Publication Data

US 2006/0201318 A1 Sep. 14, 2006

(51) Int. Cl.
*F41H 5/02* (2006.01)

(52) U.S. Cl. ..... 89/36.02

(58) Field of Classification Search ..... 89/36.02
See application file for complete search history.

(56) References Cited

U.S. PATENT DOCUMENTS 3,592,942 A * 7/1971 Hauck et al. ..... 89/36.02
3,646,715 A * 3/1972 Pope ..... 52/309.9
3,700,534 A * 10/1972 Cook et al. ..... 428/46
3,702,593 A * 11/1972 Fine ..... 109/80
4,338,368 A * 7/1982 Lovelace et al. ..... 428/212
4,545,286 A * 10/1985 Fedij ..... 89/36.02
4,579,767 A * 4/1986 Coggan et al. ..... 428/161
4,757,742 A * 7/1988 Mazelsky ..... 89/36.02
4,813,334 A * 3/1989 Bloks et al. ..... 89/36.02
4,824,624 A * 4/1989 Palicka et al. ..... 264/632
5,045,371 A * 9/1991 Calkins ..... 428/49
5,326,606 A * 7/1994 Labock ..... 428/49
5,340,633 A * 8/1994 van der Loo et al. ..... 428/114
H1434 H * 5/1995 Cytron ..... 89/36.02
5,429,875 A * 7/1995 Okamoto et al. ..... 428/547
5,705,764 A * 1/1998 Schade et al. ..... 89/36.02
5,985,433 A * 11/1999 Leiser et al. ..... 428/312.6
6,009,789 A * 1/2000 Lyons ..... 89/36.02
6,228,194 B1 * 5/2001 Cowen ..... 156/63
6,408,734 B1 6/2002 Cohen
6,532,857 B1 * 3/2003 Shih et al. ..... 89/36.02
2006/0037463 A1 2/2006 Vittoser et al.
2006/0060077 A1 * 3/2006 Lucuta et al. ..... 89/36.02
2007/0089596 A1 4/2007 Huber et al.

* cited by examiner

*Primary Examiner*—Troy Chambers
(74) *Attorney, Agent, or Firm*—Thompson Coburn LLP; Joseph M. Rolnicki

(57) ABSTRACT

A ballistic projectile resistant barrier apparatus combines the advantages provided by both high hardness material barriers and multiple laminate layer barriers. An outer tier of the barrier is comprised of a plurality of interconnected hard tiles. Each of the tiles has an outer, front surface designed that, upon impact by a ballistic projectile, the projectile is immediately deflected from its initial path. Subsequent tiers of the barrier are comprised of layers of a flexible material interspersed with layers of a ballistic liquid or at least one layer of ballistic fiber. When tiles are impacted by a projectile, the impacted tile is pushed into the laminate layers of the barrier, thereby substantially multiplying the area of the barrier that resists the impact force of the projectile as the projectile enters the barrier.

30 Claims, 6 Drawing Sheets

BALLISTIC PROJECTILE RESISTANT BARRIER APPARATUS

BACKGROUND OF THE INVENTION (1) Field of the Invention

The present invention pertains to a ballistic projectile resistant barrier with improved ballistic projectile resistance. The barrier is lightweight and can be worn as a garment or draped over an object to provide ballistic projectile protection to stationary or mobile entities, military or civilian.

(2) Description of the Related Art

In the early development of ballistic projectile barriers such as flak jackets or vehicle armor, it was a commonly agreed upon theory that the barrier must be at least as hard, or harder than the ballistic projectile to be stopped. It was necessary that the barrier be very strong with a high degree of structural integrity so that impact of the projectile with the barrier would deform the projectile into a flattened shape, thereby transferring the kinetic energy of the projectile into a larger surface area. This would allow the barrier to absorb the impact energy of the projectile while preventing penetration of the barrier. The levels of barrier thickness and hardness were adjusted in designing barriers that were impenetrable to various ballistic threats.

Another commonly accepted theory in the development of ballistic projectile barriers relies on multiple layers or laminates of a flexible material in constructing the barrier. The multiple material layers allow a degree of movement of each layer in the barrier. The movement allows a degree of stretching to occur when a layer is impacted by a projectile, which takes advantage of the material tensile strength and transfers some energy of the impact into each layer of material. The kinetic energy of the impacting projectile is more effectively spread into a larger surface area through the thickness of the barrier, with the surface area increasing on each consecutive material layer of the barrier.

Materials commonly used in laminate barriers are made of woven aramid fibers that are saturated and bonded with a matrix of thermosetting plastic resin. This produces a barrier that very effectively takes advantage of the high tensile strength of the aramid fibers.

The prior art ballistic projectile barriers that employ hard materials such as ballistic steel are disadvantaged in that they are very heavy. In high mobility applications, for example in flak jackets worn by soldiers, the increased weight of the ballistic barrier is a significant disadvantage. In addition, with the complex designs used in ballistic barriers today, the use of ballistic steel is further disadvantaged in that it is not easily fabricated.

Ceramic barriers are less dense than steel and therefore weigh less per thickness of the barrier than steel. Ceramic materials can also be produced with extremely high levels of hardness. Thus, the ceramic materials have many advantages over ballistic steel, but are very expensive and are also very difficult to fabricate in many applications.

Laminate barriers using woven layers of aramid fibers are manufactured using very complex methods. These methods of manufacture are time consuming and, in addition to the materials used, can be very expensive. Laminate barriers are most disadvantaged by their lack of hardness and their susceptibility to penetration by armor-piercing projectiles.

SUMMARY OF THE INVENTION

The ballistic projectile resistant barrier apparatus of the invention combines the advantages provided by both high hardness material barriers and multiple laminate layer barriers. The barrier of the invention also incorporates two entirely novel concepts in the construction of ballistic projectile resistant barriers. The first of these concepts is in the surface design of the barrier that, upon impact by a ballistic projectile, the projectile is immediately deflected from its initial path. This ensures that the projectile, even when initially travelling in a perpendicular path to the surface of the barrier, will ultimately impact the barrier at an oblique angle.

The second concept is in using a system of interconnected tiles of a high hardness material that when impacted by a projectile, break away from the surrounding tiles and remain substantially intact. The impacted tile is pushed into laminate layers of the barrier, thereby substantially multiplying the area of the barrier that resists the impact force of the projectile as the projectile enters the barrier.

In the preferred embodiment of the ballistic projectile resistant barrier apparatus of the invention, the above novel concepts are arranged in two tiers.

The outer surface of the ballistic projectile resistant barrier apparatus of the invention is comprised of a plurality of interconnected hard tiles that are arranged in a layer. Each of the tiles is the same in size and configuration. In the preferred embodiment, each of the tiles has a cubic shape with opposite front and rear surfaces, the front surface of each tile defining the outer surface of the barrier. The interconnected tiles are arranged in a two dimensional layer in which the front surfaces of the tiles define a surface structure of peaks and valleys, that appears as rows and columns of pyramids.

The outer surface, or front surface of each tile, has a peripheral edge that surrounds a central area of the tile. The front surface of the tile is recessed at the central area of the surface, producing equally high points at the four corners of the front surface peripheral edge. Thus, the front surface of each tile functions as a funnel that guides a ballistic projectile impacting the front surface toward the central area of the tile. Rather than piercing through the tile, the projectile will carry or push the tile into the subsequent tier of the ballistic barrier.

Each of the tiles has a substantially flat rear surface with a cylindrical projection protruding from the center of the rear surface. The projection acts as a locking mechanism that fits into a hole in the surface of the subsequent layer of the barrier. The tiles are bonded by adhesive to the barrier's subsequent layer.

In the preferred embodiment of the invention, each of the tiles is comprised of reaction bonded silicone carbide. This material is substantially harder than the majority of metal ballistic projectiles, and is at least equal in hardness to many armor piercing projectiles. Other alternative materials include alumina, hot pressed silicone carbide, boron carbide, zirconium and other comparable ceramic materials.

The second tier of the barrier apparatus of the invention is comprised of a flexible laminate made of consecutive layers of flexible material that may be interspersed with a ballistic liquid or a ballistic fiber. In one embodiment, portions of adjacent layers of material are bonded together in a spotted pattern with there being a void that extends between the adjacent layers and around the bonded portions of the layers. The ballistic liquid fills this void. In each subsequent layer of the laminate tier, the bonded portions of the adjacent layers of material are offset and misaligned with the bonded portions of material of the previous adjacent layers. The ballistic liquid fills the voids between the subsequent adjacent layers and extends around the bonded portions of the adjacent layers.

In another embodiment adjacent layers of polycarbonate sheets or other comparable or equivalent thermoplastic materials are bonded together by layers of adhesive. The polycarbonate sheets have varying thicknesses. At least one layer of a ballistic fiber is included in the construction of the second tier laminates. This multiple laminate tier of the ballistic projectile resistant barrier apparatus of the invention gives the core of the barrier an extremely high impact resistance, and impact energy absorbing ability. This tier of the barrier also has the ability to withstand a very tight pattern of impacting ballistic projectiles.

The ballistic projectile resistant barrier apparatus of the invention described above provides the advantages of being lightweight, of having a high degree of ballistic projectile impact resistance, of having a design and thickness that is readily adjustable to provide resistance to varying threat levels, is exceptionally resistant to armor-piercing projectiles, is relatively simple to manufacture, can be readily manufactured in curves or other complex shapes, and can be manufactured at relatively low cost.

BRIEF DESCRIPTION OF THE DRAWING FIGURES

Further features of the ballistic projectile resistant barrier apparatus of the invention are set forth in the following detailed description of the apparatus and in the following drawing figures in which.

DETAILED DESCRIPTION OF THE PREFERRED EMBODIMENT

Figure 1:
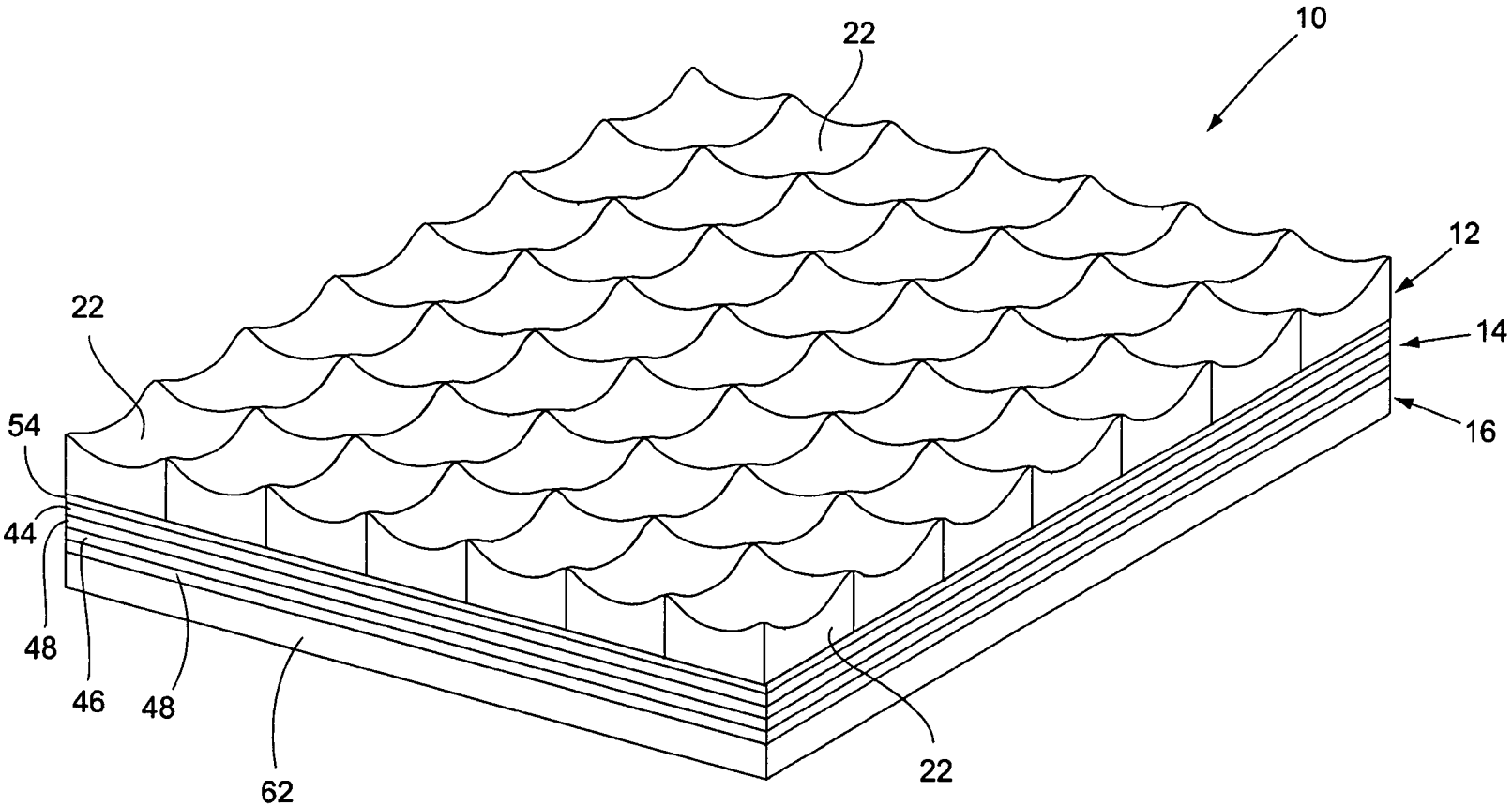
FIG. 1 is a side perspective view of a section of the ballistic projectile resistant barrier apparatus of the invention.

As stated earlier, the ballistic projectile resistant barrier apparatus of the invention combines the advantages provided by high hardness material barriers and multiple laminate layer barriers. FIG. 1 shows a representative section of a first embodiment of the apparatus 10 of the invention. The apparatus 10 is shown as being generally flat and rectangular in FIG. 1. This representation of the apparatus 10 is used for illustrative purposes only. The apparatus 10 is flexible and may be shaped to cover the contour of a variety of different shaped objects. For example, the apparatus 10 may be used in the construction of a flack jacket that protects an individual, and may be used as additional armor protection for a structure or a vehicle. Thus, the representation of the apparatus 10 shown in FIG. 1 should not be interpreted as limiting the apparatus to the particular configuration shown.

In the FIG. 1 embodiment of the ballistic projectile resistant barrier apparatus 10 of the invention, the apparatus is constructed in three tiers. These include an outer tier 12, an intermediate tier 14, and an inner tier 16. The outer tier 12 faces outwardly from the entity being protected by the apparatus 10. The inner tier 16 is positioned adjacent the protected entity. Although the apparatus 10 is show in FIG. 1 positioned generally horizontally with the outer tier 12 positioned above the inner tier 16, in use of the apparatus it may be oriented in a variety of different orientations other than that shown in FIG. 1.

The outer tier 12 of the apparatus is comprised of a plurality of hard tiles 22. Each of the tiles 22 is constructed of a material of high hardness. In the preferred embodiment, each of the tiles 22 is constructed of reaction bonded silicone carbide, although other equivalent materials may be used. Examples of these materials include alumina, hot pressed silicone carbide, boron carbide, zirconium and other comparable ceramic materials. Each of the tiles 22 is the same size and configuration. As shown in FIG. 1, each of the tiles 22 has a general cubic shape with an opposite front surface 24 and rear surface 26, and four side walls 28 extending between the front and rear surfaces. In other embodiments of the apparatus, the tiles 22 can have other sizes and shapes, for example a triangular shape.

Figure 3:
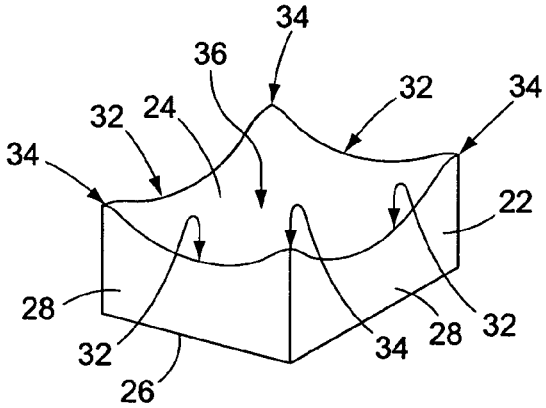
FIG. 3 is a side perspective view of an individual tile that makes up a part of the apparatus.
Figure 4:
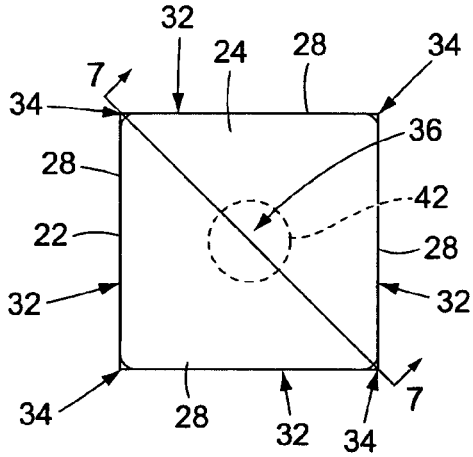
FIG. 4 is a top plan view of the tile of FIG. 3.

As best seen in FIG. 4, the four sidewalls 28 of each tile give the tile front surface 24 a square peripheral edge with four straight sections 32 and four corners 34. As best seen in FIGS. 1 and 3, the tile front surface 24 has a central area 36 that is recessed below the four corners 34 of the surface. Thus, the front surface central area 36 is spaced a first distance from the tile rear surface 26, and the front surface at each of the four corners 34 is spaced a second distance from the tile rear surface 26 that is greater than the first distance. This gives the tile front surface 24 a general funnel shape that is recessed at the central area 36 and is raised at the four corners 34. Thus, the tile front surface 24 functions as a funnel that guides a ballistic projectile impacting the front surface toward the central area 36 of the tile surface.

The tiles 22 are arranged in a two dimensional arrayed layer with the sidewalls 28 of adjacent tiles closely opposing each other. This arrangement of the tiles 22 positions the front surface corners 34 of the tiles adjacent each other. As best seen in FIG. 1, in the two dimensional arrayed arrangement of the tiles 22, the front surfaces 24 of the tiles define a surface structure of the barrier that has peaks and valleys that appear as rows and columns of pyramids.

Figure 5:
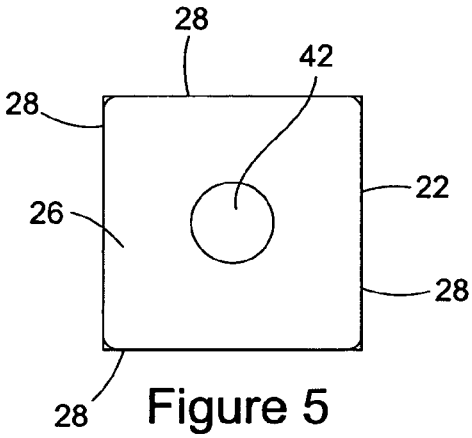
FIG. 5 is a bottom plan view of the tile of FIG. 3.
Figure 6:
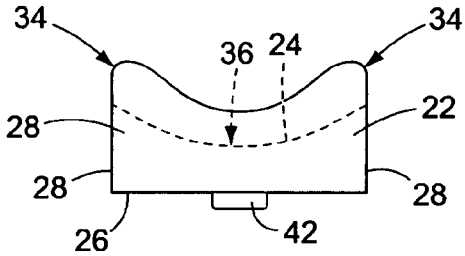
FIG. 6 is a side elevation view of the tile of FIG. 3.
Figure 7:
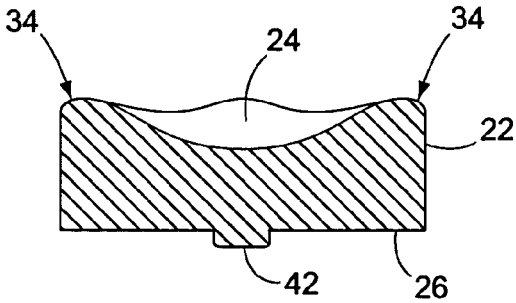
FIG. 7 is a cross section of the tile along the line 7-7 of FIG. 4.
Figure 8:
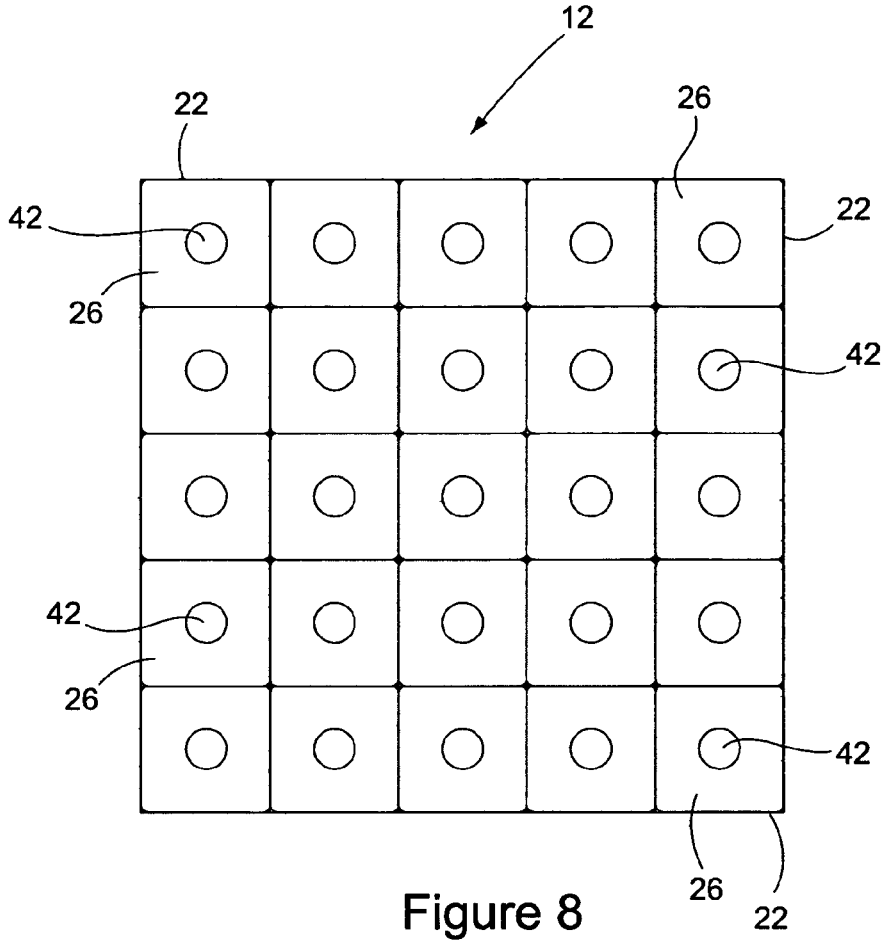
FIG. 8 is a bottom view of the array of tiles of FIG. 1.

Each of the tile rear surfaces 26 is substantially flat. As shown in FIG. 5, a cylindrical projection or pin 42 protrudes a short distance outwardly from each tile rear surface 26. The pin 42 has a cylindrical configuration and functions as a frangible connection of the tile 22 to the subsequent, intermediate tier 18 of the apparatus.

Figure 2:
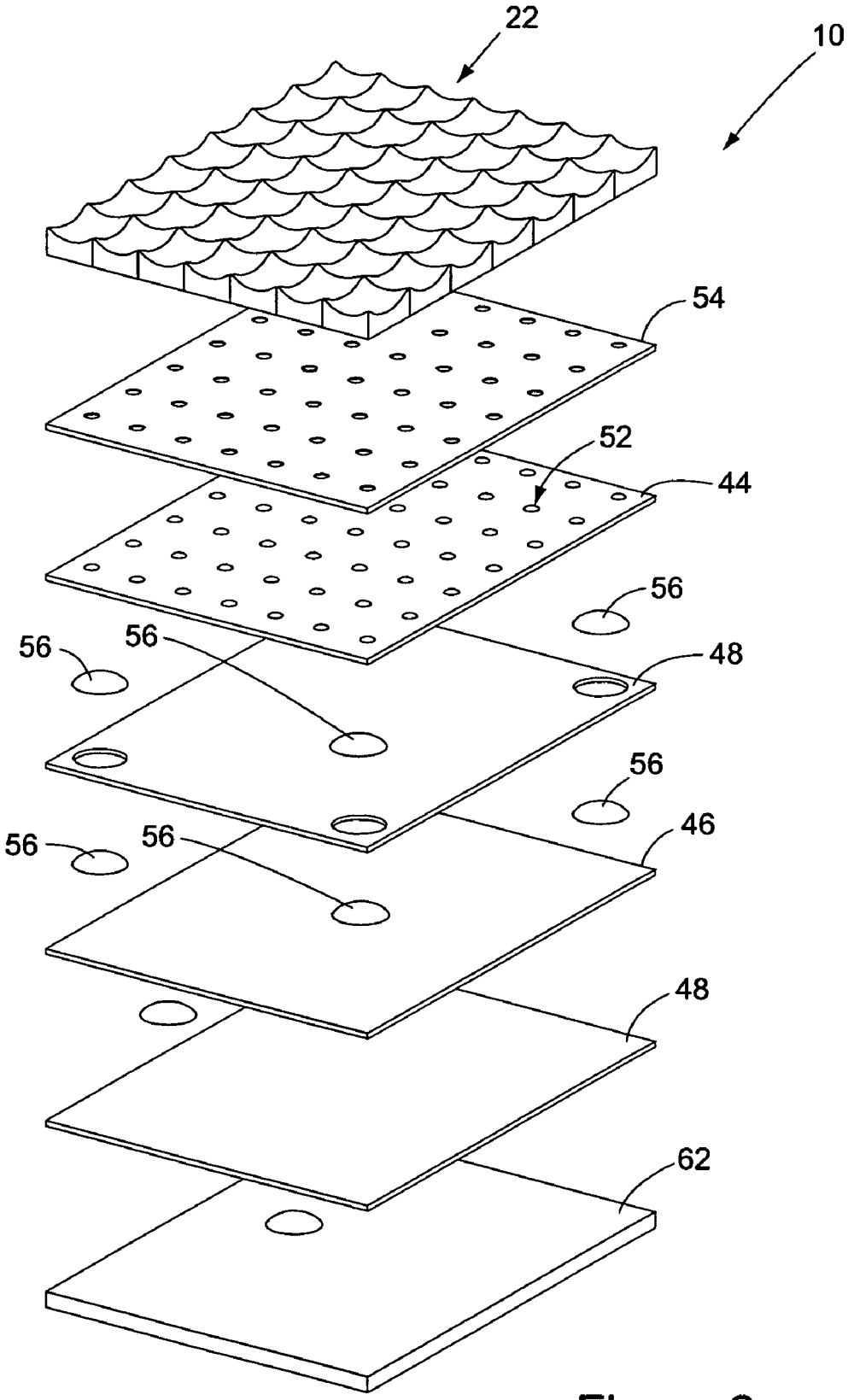
FIG. 2 is an exploded view of the apparatus shown in FIG. 1.

The second tier or intermediate tier 14 of the apparatus is a flexible laminate comprised of consecutive layers of a flexible material 44, 46 interspersed with layers of a ballistic liquid or gel 48. In the embodiment, the flexible material employed in each material layer 44, 46 is a polycarbonate or other equivalent thermoplastic material. As shown in FIG. 2, the first material layer 44 is provided with an array of holes 52 that correspond to the positions of the projections 42 on the rear surfaces of the tiles 44. The rear surfaces 26 of the tiles 22 are secured to the first material layer 44 by a layer of adhesive 54. Each of the tile rear surfaces 26 is secured by the adhesive layer 54 to the first material layer 44 with the tile projections 42 engaged in the material layer holes 52, providing a frangible connection of each of the tiles 22 to the material layer 44. The flexibility of the material layer 44 enables each of the tiles 44 to move to a limited extent relative to each other. The flexibility of the material layer 44 also enables the apparatus 10 to be formed in a variety of different configurations to conform the shape of the apparatus to the shape of a surface against which the apparatus is positioned.

In the illustrative embodiment of the apparatus 10 shown, the second tier 14 of the apparatus is comprised of two layers of the flexible material 44, 46, preferably polycarbonate sheets or other equivalent thermoplastic material. Additional layers of the material may be employed. Portions of the opposed surfaces of the two material layers 44,46 are bonded together in a spotted pattern by dabs 56 of adhesive. The spaced arrangements of the adhesive dabs 56 creates voids that extend between the opposed surfaces of the adjacent material layers 44, 46. The voids extend between the layers and around the portions of the layers secured together by the adhesive dabs 56. The ballistic liquid layer 48 fills the voids between the opposed surfaces of the material layers 44, 46. The description of the liquid layer 48 is intended to include gels and other similar types of fluids that will flow between the adjacent material layers 44, 46. In embodiments of the apparatus 10 in which there are several layers of the flexible material 44, 46, the opposed surfaces of adjacent layers are secured together by the adhesive dabs 56 in the same manner as that explained above. In addition, the voids between the adjacent layers are filled with the ballistic liquid 48. However, the positions of the adhesive dabs 56 between subsequent layers of the material 44, 46 are misaligned or staggered so that no two adhesive dabs 56 on opposite sides of a material layer are aligned with each other. This multiple laminate tier 14 of the ballistic projectile resistant barrier apparatus 10 gives the core of the barrier an extremely high impact resistance, and impact energy absorbing ability. This tier 14 of the barrier also has the ability to withstand a very tight pattern of impacting ballistic projectiles.

The third, inner tier 16 of the ballistic projectile resistant barrier apparatus 10 is a more rigid, thicker laminate layer of the flexible material 62 that makes up the laminates of the barriers second, intermediate tier 14. This backing layer or core layer of material 62 is also secured to the adjacent material layer 46 by the adhesive dabs 56. The ballistic liquid 48 fills the void formed between the backing layer 62 and the adjacent material layer 46. The liquid extends around the portions of the adjacent layers secured together by the adhesive dabs 56. This backing layer 62 of the barrier provides the barrier with increased rigidity and a final impenetrable layer that offers extreme impact resistance, and further provides the barrier with energy absorbing capability.

Figure 11:
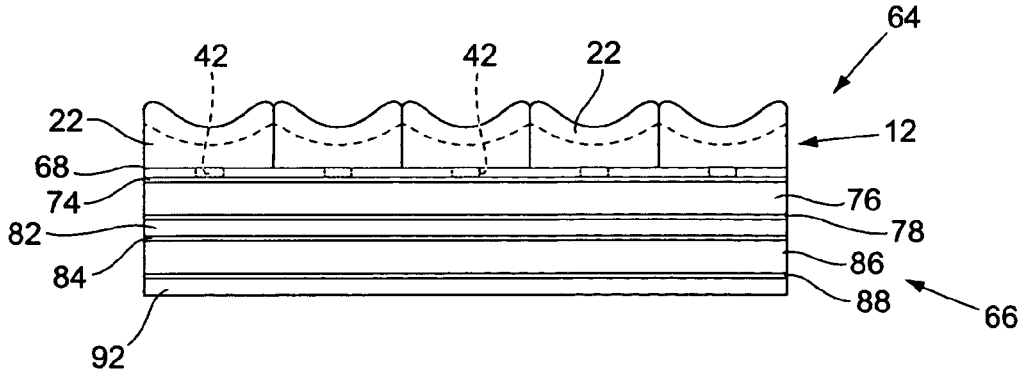
FIG. 11 is a side view of the apparatus embodiment of FIG. 9.
Figure 9:
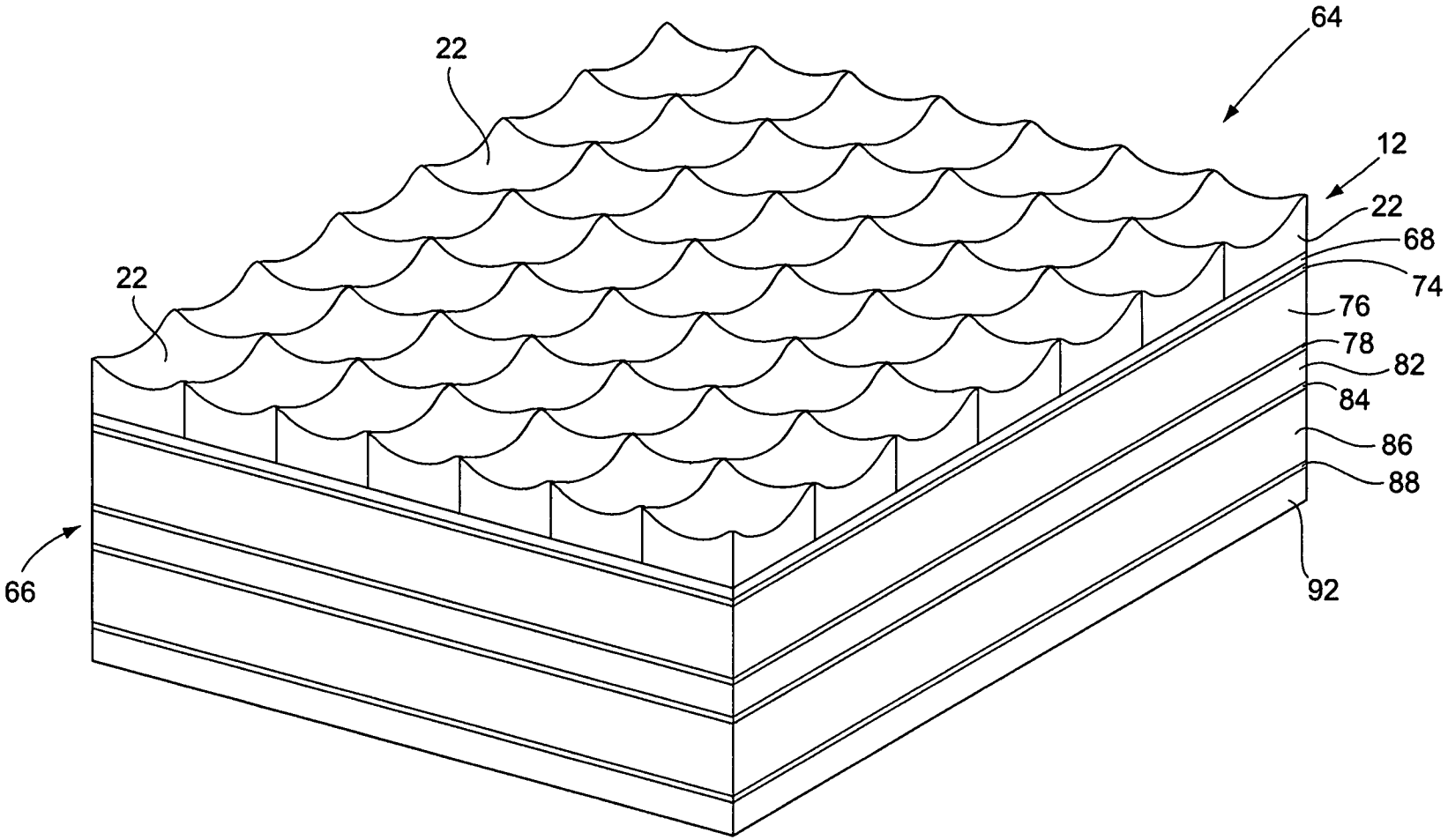
FIG. 9 is a side perspective view of a section of an additional embodiment of the apparatus.
Figure 10:
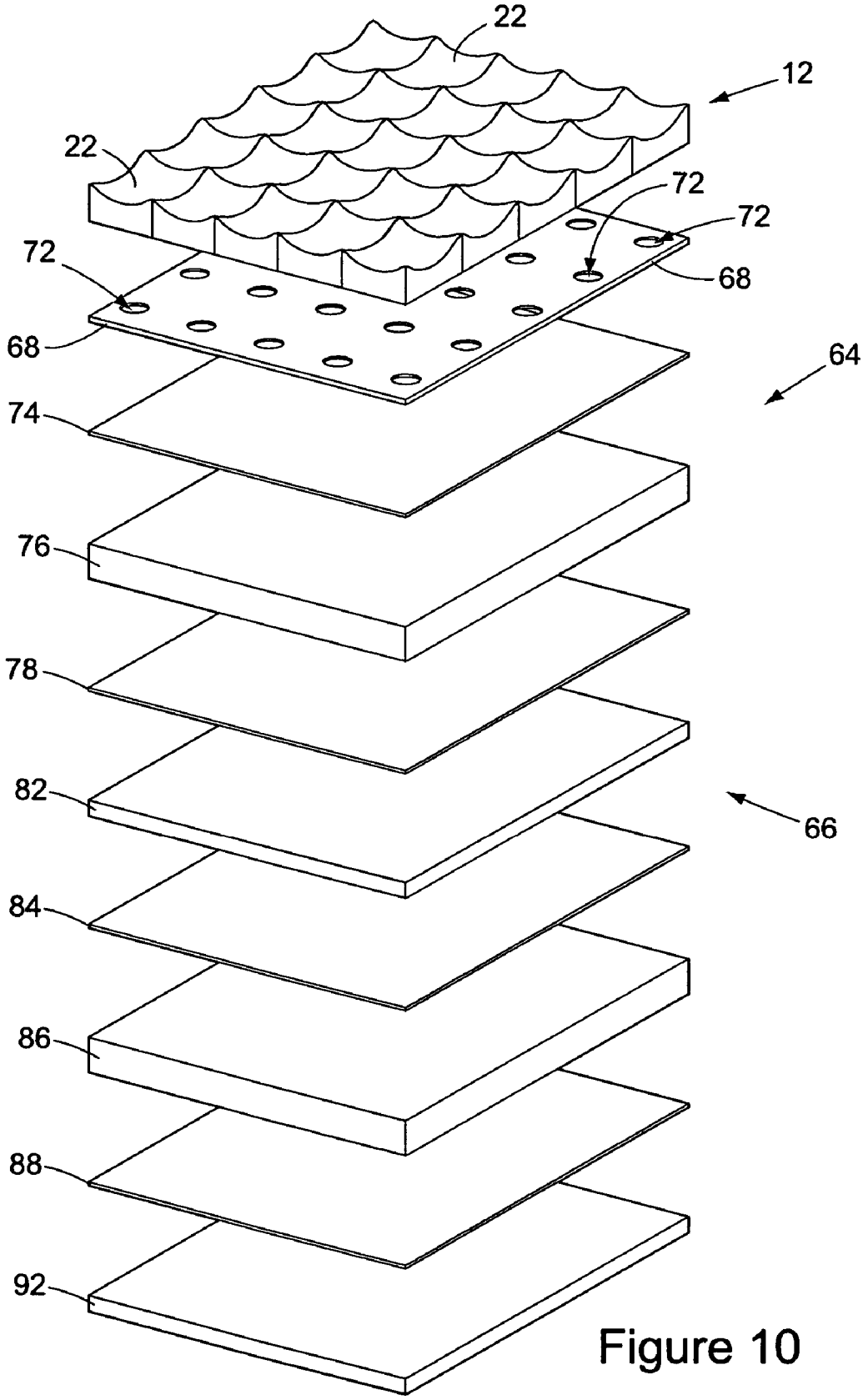
FIG. 10 is an exploded view of the apparatus embodiment of FIG. 9.

FIGS. 9-11 show a further, preferred embodiment of the ballistic projectile resistant barrier apparatus 64 of the present invention. Like the previously described embodiment, the apparatus 64 is constructed of multiple tiers. The first, or outer tier 12 is comprised of a plurality of the hard tiles 22 of the previously described embodiment of the apparatus. Each of the tiles 22 of this embodiment are substantially identical to those of the previously described embodiment, and therefore will not be described again. Because the constructions of the tiles 22 of this additional embodiment is the same as that of the previously described embodiment, the same reference numerals are used in FIGS. 9-11 in labeling each of the features of the tiles 22.

The embodiment of the apparatus 64 shown in FIGS. 9-11 differs from the previously described embodiment in the construction of the second or inner tier 66 of the apparatus. The second tier 66 of the apparatus is a flexible laminate comprised of consecutive layers of flexible materials interspersed with layers of an adhesive. In the preferred embodiment, the flexible material employed in each material layer is a polycarbonate or other equivalent thermoplastic material.

The first material layer 68 is a polycarbonate sheet having an array of holes 72 through the sheet. The pattern of the holes 72 matches the pattern of the tile projections 42 for the particular arrangement of the tiles 22. The holes 72 are dimensions to enable the tile projections 42 to pass through the holes.

A layer of a urethane adhesive 74 is applied to the opposite side of the first material layer 68 from the array of tiles 22. The adhesive 74 contacts each of the projections 42 of the tiles 22 and forms an interlocking connection of the tiles 22 to the first material layer 68.

The next layer of the laminate is a layer of ballistic fiber 76. Various different types of ballistic fiber, for example S-glass, fiberglass, aramid fiber, UMHW fibers, etc. may be employed in this layer. The layer of ballistic fiber 76 is one of the thicker layers of the laminate, for example ⅜ inch thick. The layer of adhesive 74 secures the tile projections 72 to the ballistic fiber layer 76, forming an interlocking connection between the plurality of tiles 22. This interlocking connection of the tiles 22 secures the tiles against oblique impacts of projectiles. Other equivalent means of securing together the tile rear surfaces 26 could be employed to provide the interlocking connections between the plurality of tiles 22.

A second layer of urethane adhesive 78 secures the layer of ballistic fiber 76 to a polycarbonate sheet 82. The polycarbonate sheet 82 has a lesser thickness than the ballistic fiber sheet 76, for example ⅛ inch thickness.

A third layer of adhesive 84 secures the polycarbonate sheet 82 to a polycarbonate sheet 86 of greater thickness. In the illustrative embodiment, the thicker polycarbonate sheet 86 has a thickness of ⅜ of an inch.

A still further layer of urethane adhesive 88 secures the thicker polycarbonate sheet 86 to an additional polycarbonate sheet 92. This last polycarbonate sheet 92 functions as the backing or core layer of the inner tier 66 of laminates.

Unlike the first described embodiment, each of the adhesive layers 74, 78, 84, 88 extends the length and breadth of the sheets it is sandwiched between. This enables the second tier 66 to absorb the force of projectiles that impact with the tiles 22 and to catch any shattered pieces of projectiles that impact with the tiles.

Each of the ballistic projectile resistant barrier apparatus 10, 64 described above provides the advantages of being lightweight, of having a high degree of ballistic projectile impact resistance, of having a design and thickness that is readily adjustable to provide resistance to varying threat levels, is exceptionally resistant to armor piercing projectiles, is relatively simple to manufacture, can be readily manufactured in curves or other complex shapes, and can be manufactured at relatively low cost.

Although the apparatus of the invention has been described above by reference to specific embodiments of the invention, it should be appreciated that modifications and variations could be made to the apparatus described without departing from the scope of the appended claims.

The invention claimed is:

1. A ballistic projectile resistant barrier apparatus comprising:

a plurality of interconnected hard tiles arranged in a layer, each tile of the plurality of tiles having opposite front and rear surfaces, the front surface of each tile having a peripheral edge, and the front surface of each tile being recessed into the tile from the front surface peripheral edge giving the front surface a general funnel shape, the front surfaces of the plurality of tiles together defining a outwardly facing surface of the ballistic projectile resistant barrier apparatus.

2. The apparatus of claim 1, further comprising:
a flexible interconnection between the plurality of tiles that permits relative movement between the plurality of tiles.

3. The apparatus of claim 2, further comprising:
a layer of flexible material secured to each tile of the plurality of tiles providing the flexible interconnection between the plurality of tiles.

4. The apparatus of claim 1, further comprising:
the front surface of each tile having a same configuration.

5. The apparatus of claim 4, further comprising:
the rear surface of each tile having a same configuration, with the rear surface configuration being different from the front surface configuration.

6. The apparatus of claim 1, further comprising:
each tile of the plurality of tiles being constructed of reaction bonded silicone carbide.

7. The apparatus of claim 1, further comprising:
the plurality of tiles being arranged in a two dimensional array.

8. The apparatus of claim 1, further comprising:
each tile of the plurality of tiles having a plurality of side walls that extend between the front and rear surfaces of each tile and extend around the front and rear surfaces of each tile.

9. The apparatus of claim 8, further comprising:
each tile of the plurality of tiles having four side walls that together with the front and rear surfaces of each tile give each tile a cube configuration.

10. The apparatus of claim 8, further comprising:
the side walls of adjacent tiles of the plurality of tiles oppose each other.

11. The apparatus of claim 1, further comprising:
each tile front surface having a central area spaced a first distance from the rear surface of the tile; and,
each tile front surface peripheral edge having portions that are spaced a second distance from the rear surface of the tile with the second distance being larger than the first distance.

12. The apparatus of claim 1, further comprising:
each tile front surface peripheral edge having a plurality of straight sections that are interconnected by a plurality of corners.

13. The apparatus of claim 12, further comprising:
the straight sections of the peripheral edges of adjacent tiles of the plurality of tiles being positioned parallel to each other.

14. The apparatus of claim 12, further comprising:
the corners of the peripheral edges of adjacent tiles of the plurality of tiles being positioned adjacent each other.

15. The apparatus of claim 12, further comprising:
each tile front surface having a central area spaced a first distance from the tile rear surface; and,
the corners of the peripheral edges of each tile being spaced a second distance from the tile rear surface, the second distance being larger than the first distance.

16. A ballistic projectile resistant barrier apparatus comprising:
a plurality of interconnected hard tiles arranged in a layer, each tile of the plurality of tiles having opposite front and rear surfaces, the front surface of each tile having a peripheral edge and a central area within the peripheral edge, the central area of the front surface being recessed into the tile from the front surface peripheral edge giving the front surface a general funnel shape, the front surfaces of the plurality of tiles together defining a outwardly facing surface of the ballistic projectile resistant barrier apparatus.

17. The apparatus of claim 16, further comprising:
a flexible interconnection between the plurality of tiles that permits relative movement between the plurality of tiles.

18. The apparatus of claim 17, further comprising:
a layer of flexible material secured to each tile of the plurality of tiles providing the flexible interconnection between the plurality of tiles.

19. The apparatus of claim 16, further comprising:
the front surface of each tile having a same configuration.

20. The apparatus of claim 19, further comprising:
the rear surface of each tile having a same configuration, with the rear surface configuration being different from the front surface configuration.

21. The apparatus of claim 16, further comprising:
each tile of the plurality of tiles being constructed of reaction bonded silicone carbide.

22. The apparatus of claim 16, further comprising:
the plurality of tiles being arranged in a two dimensional array.

23. The apparatus of claim 16, further comprising:
each tile of the plurality of tiles having a plurality of side walls that extend between the front and rear surfaces of each tile and extend around the front and rear surfaces of each tile.

24. The apparatus of claim 23, further comprising:
the side walls of adjacent tiles of the plurality of tiles oppose each other.

25. The apparatus of claim 23, further comprising:
each tile of the plurality of tiles having four side walls that together with the front and rear surfaces of each tile give each tile a cube configuration.

26. The apparatus of claim 16, further comprising:
each tile front surface central area being spaced a first distance from the rear surface of the tile; and,
each tile front surface peripheral edge having portions that are spaced a second distance from the rear surface of the tile with the second distance being larger than the first distance.

27. The apparatus of claim 16, further comprising:
each tile front surface peripheral edge having a plurality of straight sections that are interconnected by a plurality of corners.

28. The apparatus of claim 27, further comprising:
the straight sections of the peripheral edges of adjacent tiles of the plurality of tiles being positioned parallel to each other.

29. The apparatus of claim 27, further comprising:
the corners of the peripheral edges of adjacent tiles of the plurality of tiles being positioned adjacent each other.

30. The apparatus of claim 27, further comprising:
each tile front surface central area being spaced a first distance from the tile rear surface; and,
the corners of the peripheral edges of each tile being spaced a second distance from the tile rear surface, the second distance being larger than the first distance.

* * * * *